US008104306B1

(12) United States Patent
Elsner

(10) Patent No.: US 8,104,306 B1
(45) Date of Patent: Jan. 31, 2012

(54) FREEZABLE SQUIRREL CAGE EVAPORATOR

(76) Inventor: Steven C. Elsner, Tonopah, AZ (US)

( * ) Notice: Subject to any disclaimer, the term of this patent is extended or adjusted under 35 U.S.C. 154(b) by 557 days.

(21) Appl. No.: 11/545,210

(22) Filed: Oct. 10, 2006

Related U.S. Application Data

(60) Provisional application No. 60/725,559, filed on Oct. 11, 2005.

(51) Int. Cl.
*F25D 17/06* (2006.01)

(52) U.S. Cl. ..... 62/426; 62/95; 62/304; 62/305; 62/306; 62/332; 62/333

(58) Field of Classification Search ..... 62/95, 426, 62/304, 305, 306, 332, 333
See application file for complete search history.

(56) References Cited

U.S. PATENT DOCUMENTS

| | | | | |
|---|---|---|---|---|
| 4,479,366 | A * | 10/1984 | Lanier et al. | 62/304 |
| 4,698,979 | A * | 10/1987 | McGuigan | 62/171 |
| 5,317,884 | A * | 6/1994 | Lyon | 62/507 |
| 5,383,337 | A | 1/1995 | Baker | |
| 6,298,677 | B1 * | 10/2001 | Bujak, Jr. | 62/158 |
| 6,485,547 | B1 * | 11/2002 | Iijima | 96/242 |
| 6,519,966 | B1 * | 2/2003 | Martin, Sr. | 62/324.1 |
| 6,574,975 | B2 * | 6/2003 | Bourne et al. | 62/171 |
| 6,651,455 | B1 * | 11/2003 | Yoho, Sr. | 62/305 |
| 6,666,038 | B1 * | 12/2003 | Hynes | 62/171 |
| 2001/0045271 | A1 * | 11/2001 | Li | 165/104.29 |
| 2003/0094011 | A1 * | 5/2003 | Zakryk et al. | 62/291 |
| 2003/0136143 | A1 * | 7/2003 | Johnson et al. | 62/304 |
| 2003/0209030 | A1 * | 11/2003 | Nishida et al. | 62/500 |

FOREIGN PATENT DOCUMENTS

JP 02195175 A * 8/1990

* cited by examiner

*Primary Examiner* — Cheryl J Tyler
*Assistant Examiner* — Jonathan Koagel
(74) *Attorney, Agent, or Firm* — Snell & Wilmer L.L.P.

(57) ABSTRACT

A fan driven evaporator is one component for use in refrigeration applications such as an evaporative cooler which employs refrigeration. In one embodiment, a frosting evaporative cooler utilizes an evaporator in the shape of a squirrel cage blower that utilizes alternating and opposing flows of refrigerant in refrigerant tubing to allow for the dehumidifying and cooling of humid air without freezing over and losing air flow. A fan for use in coolers in humid conditions comprises a motor driving a centrifugal blower. At least two cooling coils that are parallel have cooling fins separating all the coils. The coils surround the blower wheel thereby matching the shape of the outside of the blower housing.

20 Claims, 3 Drawing Sheets

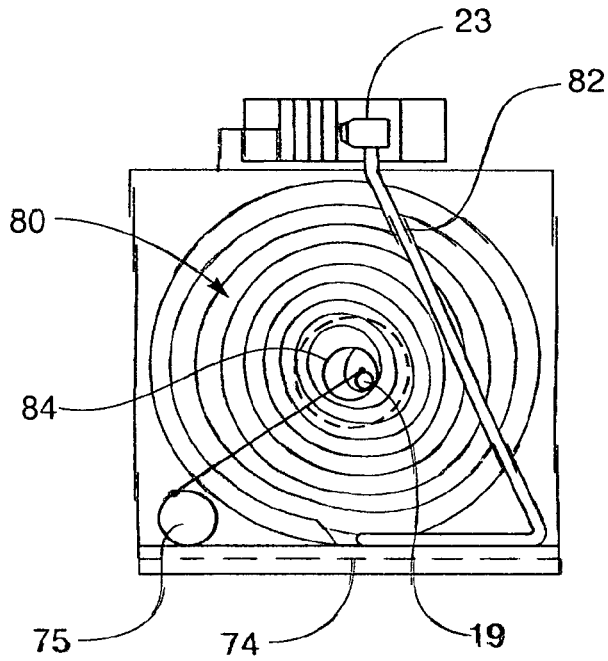
FIG. 9.
FIG. 6.
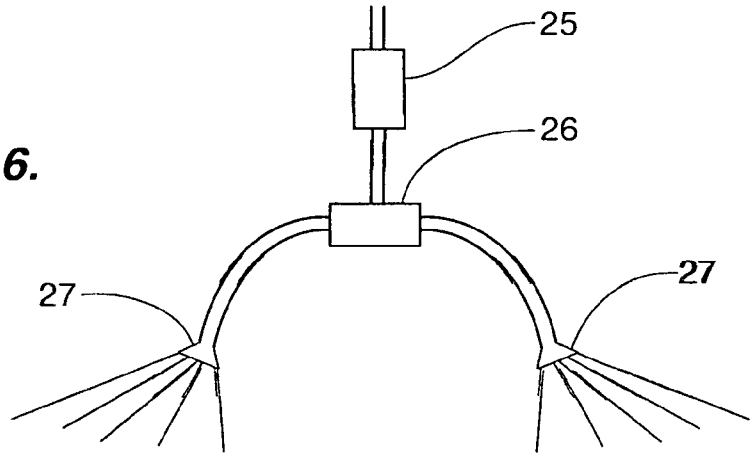

FREEZABLE SQUIRREL CAGE EVAPORATOR

RELATED APPLICATION

This application is a continuation-in-part of co-pending application Ser. No. 60/725,559 filed Oct. 11, 2005.

TECHNICAL FIELD

The present invention relates to refrigeration devices which are used in dry and humid climates for the cooling of buildings such as residential homes, and, more particularly, to a fan which employs refrigerants.

BACKGROUND OF THE INVENTION

An evaporator fan for cooling and dehumidification. One application, but not limited to, a device commonly referred to as a swamp cooler is essentially a large box-like frame containing a large fan. The fan is enclosed by one or more water-wetted pads usually made of excelsior or cellulose. In use, the fan draws in hot outside air through the wetted pads (which are continually soaked by water from a pump), cooling the air as the air evaporates water molecules from the water-wetted pads. The fan blows the water-cooled air into the house or building that is being cooled and then out a deliberate vent.

It is often called a swamp cooler because on high humidity days cooling is diminished due to lack of evaporation in the pads making the area feel muggy similar to a swamp. On dry days, a standard swamp cooler works fine. In an area, such as Arizona, where the high humidity monsoon air occurs for short periods the cooling and dehumidifying affects of this evaporator would enhance capabilities.

The typical swamp cooler (aka evaporative cooler) operates with a low horsepower motor which pumps water from the floor, or tank, of the cooler to the top of the cooler and over the pads. The water level in the tank is kept constant with a float valve that opens when water is needed to keep the tank full due to loss of evaporation.

When the pumped water reaches the top of the cooler pads it proceeds to trickle down the face of the cooler pads being drawn through and evaporated off. A second motor drives the fan which draws air from the outside through the pads, then pushes the cooled air into the desired area. Significant cooling effect is produced when the water evaporates as air passes through the pads. The cooling is produced by evaporation converting liquid water to vapor. As stated above, the problem with swamp coolers are that they do not work well during humid periods. Several attempts have been made to solve this problem.

U.S. Pat. No. 5,383,337 to Baker describes an apparatus for pre-cooling water supplied to a "swamp cooler". What is needed is a device that allows a swamp cooler to be used in humid conditions but absolves the necessity of pre-cooling the water separately and prior to use by the swamp cooler. The present invention meets this need.

SUMMARY OF THE INVENTION

It is an object of the present invention to provide a fan driven evaporator as one component for use in refrigeration applications such as evaporative cooler which employs refrigeration.

Further objects and advantages will become apparent as the following description proceeds and the features of novelty which characterize this invention will be pointed with particularity in the claims annexed to and forming a part of this specification.

BRIEF DESCRIPTION OF THE DRAWINGS

The present invention may be more readily described by reference to the accompanying drawings in which:

FIG. 6 is an enlarged drawing of the metering device reversing valve defuser tubing going to the evaporator;

FIG. 9 is a view of the top with the scroll shaped water channel with condenser submerged in water, known in the art as water-cooled condenser;

DESCRIPTION OF THE PREFERRED EMBODIMENT

Figure 4:
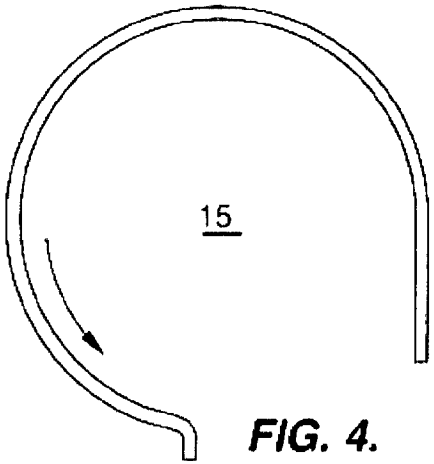
FIG. 4 is a sectional view of the shape of the evaporator tubing of the evaporator shown in FIG. 1 showing refrigerant flow in a clockwise direction.
Figure 3:
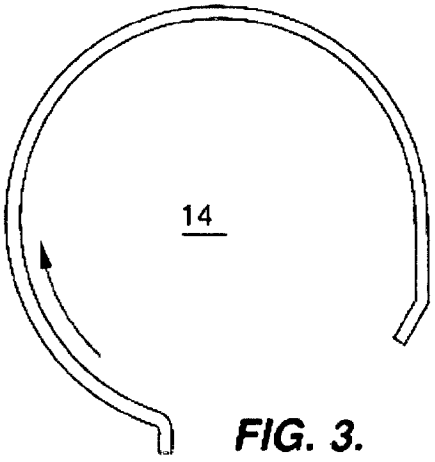
FIG. 3 is a cross sectional view of the shape of the evaporator tubing of the evaporator shown in FIG. 1 showing refrigerant flow in a counter-clockwise direction.
Figure 2:
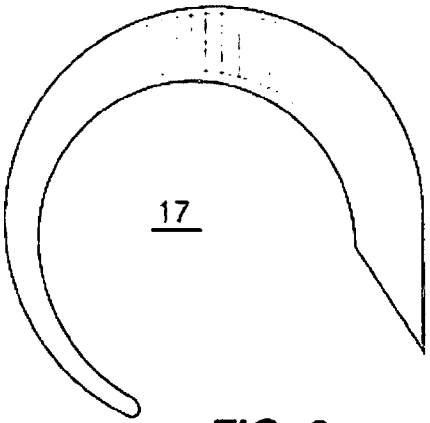
FIG. 2 is a view of one of several cooling fins used in the present invention depicted in FIG. 1.
Figure 5:
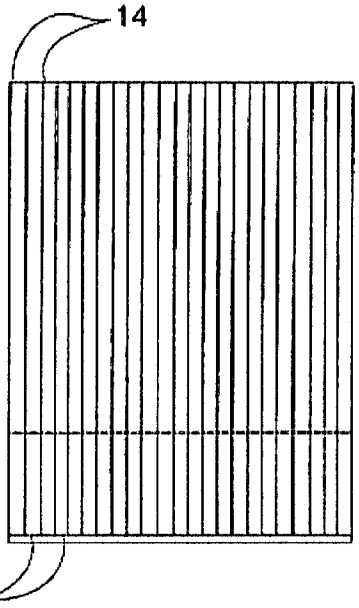
FIG. 5 is the side view of the squirrel cage fan evaporator showing the evaporator tubing separated by fins also showing liquid and suction connections to evaporator tubing.
Figure 1:
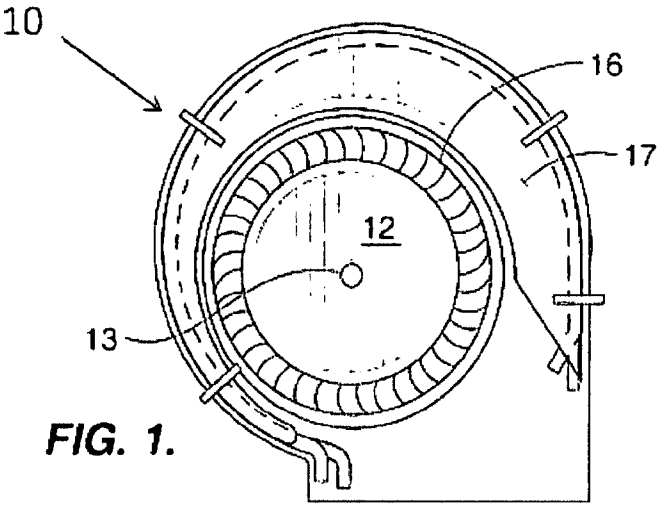
FIG. 1 is the open end view of the squirrel cage fan evaporator in accordance with the present invention.

As shown in the attached FIGS. 1 through 7, the present invention provides a squirrel cage evaporator 10 having a centrifugal fan wheel 12 with alternating refrigerant cooling coils 14, 15 encircling and comprising the outside diameter of the centrifugal fan wheel 12. The centrifugal fan wheel 12 includes an electric motor 13 having many mounting characteristics known in the art. As best seen in FIG. 2, fins 17 divide each of the reversing flow refrigerant evaporator coils 14, 15. This configuration is such that cooling fins 17 separating coils 14, 15 increases the service area of evaporator 10 thereby allowing evaporator 10 to be partially frozen in the direction of the refrigerant flow, which will defrost on a reverse cycle in every other tube as described in more detail below.

As best seen in FIG. 6, a liquid line 19 leaves a condenser 80 having a filter-drier and sight glass all known in the art and supplying a metering device 25 at which point the liquid converts to a gas known in the art as "flashing". Liquid line 19 continues to a reversing valve 26 supplying flow in opposite directions through a plurality of diffusers 27 to supply each evaporator coil 14, 15 with its own supply of refrigerant.

In more detail, squirrel cage evaporator 10 with its opposing flow of refrigerant when applied to an evaporative cooler 70 know in the art adds to the cooling capabilities of said cooler 70 by dehumidifying the air passing over partially freezing evaporative coils 14, 15. With evaporative coils 14, 15 freezing in alternating directions a frost pattern will alternate between one set of coils allowing the other set of coils not supplied to defrost. The condensing water, known in the art as condensate, moves along the radius forced by the velocity of the air to exit fins 17 and is directed via conduit 28 to a tank 76 of the evaporative cooler 70 thereby providing a large portion of the humidity as condensation to tank 76.

As air is blown over fin 17, heat is removed from evaporative coils 14, 15 via convective cooling. The present invention is suitable for use with many refrigerants, including but not limited to, R404 refrigerant which has a −40° F. expansion point. When evaporator 10 reaches the end of a pre-determined cycle of circulating refrigerant, ice starts to accumulate on the evaporator coils 14, for example. Reversing valve 26 switches flow to evaporative coils 15 thereby beginning to circulate refrigerant in the opposite direction of coils 14. At the next end of the pre-determined cycle, reversing valve 26 switches flow direction again to provide refrigerant to coils 14 again. By cycling the flow of refrigerant between coils 14, 15, the evaporative coils 15, 14 are allowed to thaw and therefore any accumulation of ice is prevented.

Evaporative coils 14, 15 are parallel to one another and, preferably, made of metal though those skilled in the art will recognize that other materials may be suitable for use. In the metal embodiment, coils 14, 15 and fins 17 are made of aluminum. In the preferred embodiment, evaporative coils 14, 15 are in contact with fins 17 separating each coil 14 from an adjoining coil 15. In the presently preferred embodiment, reversing valve 26 which is also known as a three way solenoid, is utilized to achieve the alternating flow.

Figure 7:
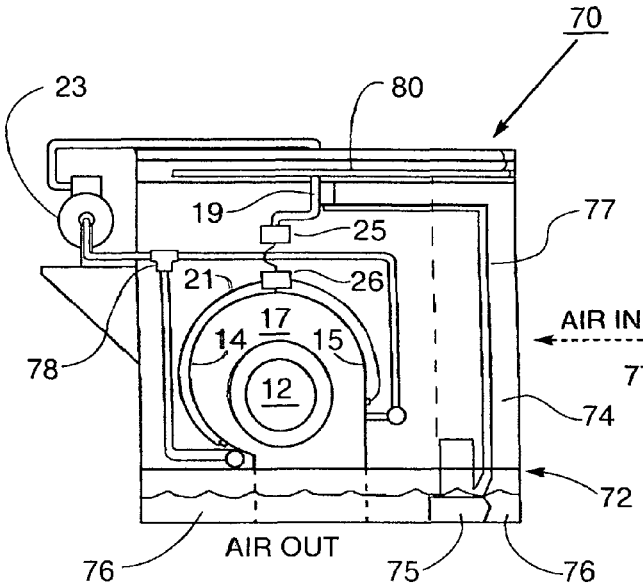
FIG. 7 is a side cross section view showing the squirrel cage evaporator positioned inside the evaporative cooler used in the present invention.
Figure 8:
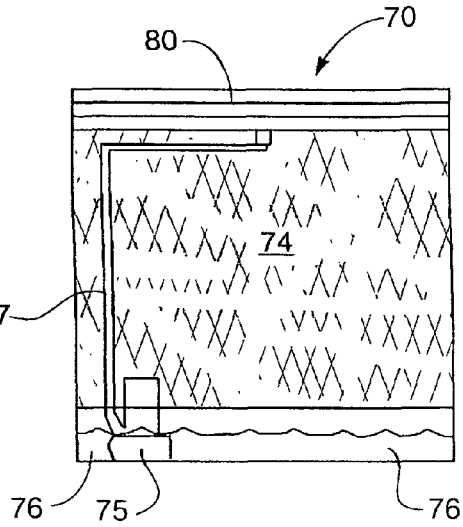
FIG. 8 is the end view of the evaporative cooler with air intake through evaporative pad also showing location of water pump and tubing to water cooled condenser.
Figure 10:
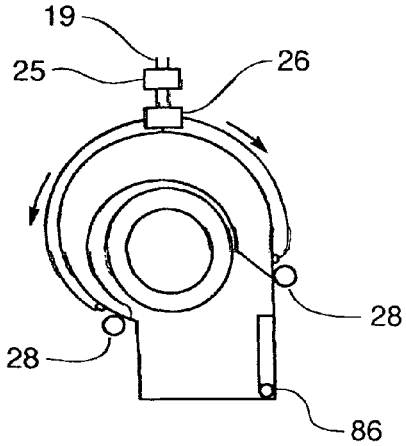
FIG. 10 is a close up view of the squirrel cage fan of FIG. 7.
Figure 11:
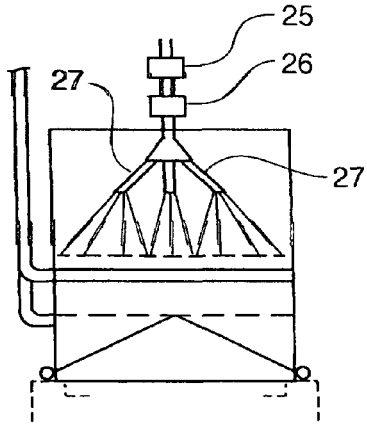
FIG. 11 is a schematic view of the metering valve, reversing valve and conduit of FIG. 7.

Turning now to FIGS. 7-9, evaporative cooler 70 is shown which employs the present invention. As shown, evaporative cooler 70 provides a box like housing 72 having an evaporative pad 74 comprising one side thereof. Evaporative pad 74 is generally a wet cardboard material which allows air to pass there through. As the air passes there through, it evaporates some of the water in pad 74 and is thusly cooled. To keep pad 74 moist, the bottom of housing 70 form tank 76 which is filled with water, which is pumped water 75 through pipe 77 to the top of unit 80 to flow down the pad 74.

Squirrel cage fan 12 of the present invention is mounted within housing 70. The air output side of fan 12 extends downwardly through the bottom of housing 70. Squirrel cage evaporator fan 12, when operating, pulls air through pad 74 cooling and dehumidifying the air downwardly through the output side. Such operations and variations thereof are well known in the art and will not be further discussed herein.

As shown, the suction side of evaporator coils 14, 15 are joined at fitting 78 and hence to the suction side of a compressor 23. From that point, compressor 23 condenses refrigerant through an inlet 82 to condenser 80 mounted on top of housing 70 in liquid line 19. In the preferred embodiment, as best seen in FIG. 9, condenser 80 is in the shape of a spiral with an inlet 82 on the outer edge of the spiral down liquid line 19 from the center of the spiral positioned just above squirrel cage fan 12.

In one variation of the present invention, condensed water from the coils will drip into tank 76 thereby providing indeterminate amount of "calcium free" water to the reservoir at the bottom of the evaporative cooler providing for a cleaner environment and longer life set of filter pads. In addition, tubing 77 from a water pump 75 pumps reservoir water into the middle of the spiral of condenser 80. The water runs along condenser 80 opposite the refrigerant flow in liquid line 19 thereby providing further cooling of the refrigerant contained therein before encountering pad 74 where it drops down the front of pad 74 for cooling purposes.

While the invention has been particularly shown and described with reference to a preferred embodiment, it will be understood by those skilled in the art that various changes in form and detail may be made therein without departing from the spirit and scope of the invention. Thus, this description is not to be construed in a limiting sense. Modification of the disclosed embodiments, as well as alternative embodiments of this invention, will be and are apparent to persons of ordinary skill in the art. For example, the present invention may be modified to be used in conjunction with all types of refrigeration, air conditioning and dehumidification.

That which is claimed is:

1. A refrigeration system having an evaporator, compressor, condenser, and metering valve, operating in conjunction with an evaporative cooler having a housing containing an evaporative pad, a centrifugal blower assembly comprising a motor, a centrifugal squirrel cage fan and a blower shell, and a tank configured to provide the evaporative pads with an evaporative liquid, wherein the evaporator further comprises:

a three way solenoid valve which receives a refrigerant from the condenser and outputs the refrigerant to the evaporator through a first outlet and a second outlet, wherein the three way solenoid valve alternates refrigerant between the first outlet and the second outlet based upon a first cycle and a second cycle;

a first evaporator tube having a first end and a second end, the first end is directly connected to the first outlet, wherein the first evaporator tube transports refrigerant to a suction fitting connected in line with the compressor during the first cycle, wherein the second end is connected to the suction fitting;

a second evaporator tube having a first end and a second end, the first end is directly connected to the second outlet, wherein the second evaporator tube transports refrigerant to the suction fitting connected in line with the compressor during the second cycle, wherein the second end is connected to the suction fitting; and a fin in contact with the first evaporator tube and the second evaporator tube, wherein the first evaporator tube and the second evaporator tube are in parallel contact with the fin along most of the fin's length, wherein the fin is sandwiched between the first evaporator tube and the second evaporator tube, wherein the first evaporator tube and the second evaporator tube are biased toward an edge of the fin farthest from the centrifugal squirrel cage fan.

2. The evaporator of claim 1, wherein the fin occupies a space between an exterior of the centrifugal squirrel cage fan and the blower shell, wherein the fin is perpendicular to and wraps around a portion of an axis of the centrifugal blower approximately the same extent as the blower shell, wherein the first evaporator tube and the second evaporator tube are proximate to the blower shell.

3. The evaporator of claim 1, wherein the refrigerant in the first evaporator tube flows in the opposite direction from the refrigerant in the second evaporator tube.

4. The evaporator of claim 1, further comprising: a plurality of fins and evaporator tubes, wherein the plurality of fins and evaporator tubes are stacked continuing the pattern of the first tube, the fin and the second tube such that every other tube in the plurality of tubes transports refrigerant during the first cycle and the remaining tubes transport refrigerant during the second cycle.

5. The evaporator of claim 1, wherein the fin is narrow on a first end and progressively widens to a second end.

6. The evaporator of claim 1, wherein the refrigerant has a −40 degree expansion point.

7. The evaporator of claim 1, wherein the change between the first cycle and the second cycle is determined by at least one of time in the cycle, refrigerant pressure, and refrigerant temperature.

8. A refrigeration evaporator being a part of a refrigeration system having a metering valve, a compressor, and a condenser with coils, wherein the evaporator comprises:

a three way solenoid valve which receives a refrigerant from the metering valve and outputs the refrigerant to a first outlet and a second outlet, wherein the three way solenoid valve alternates refrigerant between the first outlet and the second outlet based upon a first cycle and a second cycle;

a first evaporator tube having a first end and a second end, the first end is directly connected to the first outlet, wherein the first evaporator tube transports refrigerant to a suction fitting connected in line with the compressor during the first cycle, wherein the second end is connected to the suction fitting;

a second evaporator tube having a first end and a second end, the first end is directly connected to the second outlet, wherein the second evaporator tube transports refrigerant to the suction fitting connected in line with the compressor during the second cycle, wherein the second end is connected to the suction fitting; and a fin in contact with the first evaporator tube and the second evaporator tube, wherein the first evaporator tube and the second evaporator tube are in parallel contact with the fin along most of the fin's length, wherein the fin is sandwiched between the first evaporator tube and the second evaporator tube.

9. The evaporator of claim 8, wherein the fin occupies a space between an exterior of the centrifugal squirrel cage fan and the blower shell, wherein the fin is perpendicular to and wraps around a portion of an axis of the centrifugal blower approximately the same extent as the blower shell, wherein the first evaporator tube and the second evaporator tube are proximate to the blower shell.

10. The evaporator of claim 8, wherein the refrigerant in the first evaporator tube flows in the opposite direction from the refrigerant in the second evaporator tube.

11. The evaporator of claim 8, further comprising: a plurality of fins and evaporator tubes, wherein the plurality of fins and evaporator tubes are stacked continuing the pattern of the first tube, the fin and the second tube such that every other tube in the plurality of tubes transports refrigerant during the first cycle and the remaining tubes transport refrigerant during the second cycle.

12. The evaporator of claim 8, wherein the fin is narrow on a first end and progressively widens to a second end.

13. The evaporator of claim 8, wherein the refrigerant has a −40 degree expansion point.

14. The evaporator of claim 8, wherein the alternating between the first cycle and the second cycle is determined by at least one of time in the cycle, refrigerant pressure, and refrigerant temperature.

15. An evaporator in a refrigeration system comprising:

a three way solenoid valve which receives a refrigerant from a metering valve and outputs the refrigerant to a first outlet and a second outlet, wherein the three way solenoid valve alternates refrigerant between the first outlet and the second outlet based upon a first cycle and a second cycle;

a first evaporator tube having a first end and a second end, the first end is directly connected to the first outlet, wherein the first evaporator tube transports refrigerant to a suction fitting connected in line with the compressor during the first cycle, wherein the second end is connected to the suction fitting;

a second evaporator tube having a first end and a second end, the first end is directly connected to the second outlet, wherein the second evaporator tube transports refrigerant to the suction fitting connected in line with the compressor during the second cycle, wherein the second end is connected to the suction fitting; and a fin in contact with the first evaporator tube and the second evaporator tube, wherein the first evaporator tube and the second evaporator tube are in parallel contact with the fin along most of the fin's length, wherein the fin is sandwiched between the first evaporator tube and the second evaporator tube.

16. The evaporator of claim 15, wherein the fin occupies a space between an exterior of the centrifugal squirrel cage fan and the blower shell, wherein the fin is perpendicular to and wraps around a portion of an axis of the centrifugal blower approximately the same extent as the blower shell, wherein the first evaporator tube and the second evaporator tube are proximate to the blower shell.

17. The evaporator of claim 15, wherein the refrigerant in the first evaporator tube flows in the opposite direction from the refrigerant in the second evaporator tube.

18. The evaporator of claim 15, further comprising: a plurality of fins and evaporator tubes, wherein the plurality of fins and evaporator tubes are stacked continuing the pattern of the first tube, the fin and the second tube such that every other tube in the plurality of tubes transports refrigerant during the first cycle and the remaining tubes transport refrigerant during the second cycle.

19. The evaporator of claim 15, wherein the fin is narrow on a first end and progressively widens to a second end as the fin wraps around an axis of a centrifugal squirrel cage fan.

20. The evaporator of claim 15, wherein the change between the first cycle and the second cycle is determined by at least one of time in the cycle, refrigerant pressure, and refrigerant temperature.

* * * * *